US005711459A

United States Patent [19]

Glynn

[11] Patent Number: 5,711,459

[45] Date of Patent: Jan. 27, 1998

[54] DOUBLE ACTION TRIGGER SPRAYER

[75] Inventor: Kenneth P. Glynn, Raritan Township, Hunterdon County, N.J.

[73] Assignee: Ideal Ideas, Inc., Flemington, N.J.

[21] Appl. No.: 623,894

[22] Filed: Mar. 25, 1996

Related U.S. Application Data

[63] Continuation-in-part of Ser. No. 511,917, Aug. 7, 1995, Pat. No. 5,622,287.

[51] Int. Cl.[6] ..... B67D 5/40

[52] U.S. Cl. ..... 222/318; 222/383.1; 239/333

[58] Field of Search ..... 222/318, 340, 222/341, 383.1, 385; 239/333

[56] References Cited

U.S. PATENT DOCUMENTS

| | | | |
|---|---|---|---|
| 3,701,478 | 10/1972 | Tada | 239/333 |
| 3,945,401 | 3/1976 | Greenwood | 137/627.5 |
| 4,079,865 | 3/1978 | Kutik | 222/259 |
| 4,109,832 | 8/1978 | Kutik et al. | 222/318 |
| 4,225,060 | 9/1980 | Kutik et al. | 222/189 |
| 4,396,132 | 8/1983 | Christensen | 222/1 |
| 4,503,996 | 3/1985 | Sorm et al. | 222/321 |
| 4,646,969 | 3/1987 | Sorm et al. | 239/106 |
| 4,830,046 | 5/1989 | Holt | 137/460 |
| 5,465,880 | 11/1995 | Glynn | 222/321.8 |
| 5,575,407 | 11/1996 | Foster et al. | 222/383.1 X |
| 5,622,287 | 4/1997 | Glynn | 222/383.1 X |

*Primary Examiner*—Joseph Kaufman

*Attorney, Agent, or Firm*—Kenneth P. Glynn, Esq.

[57] ABSTRACT

The present invention is a continuous action trigger sprayer for spraying liquid material. It includes a main housing having connectors to a container and having an operation cylinder and a liquid chamber. It also includes a pumping element which is within the operation cylinder and has a valve seat, a one-way valve and a pumping rod, which permits liquid material to pass therethrough in a relative direction toward a spray nozzle, but not toward the liquid chamber. There is a relief valve having a seat with an opening therethrough and a relief passage to bleed liquid back to the container and which cooperates with the pumping element. There is also a trigger which moves the pumping element.

19 Claims, 1 Drawing Sheet

DOUBLE ACTION TRIGGER SPRAYER

REFERENCE TO RELATED APPLICATION

This application is a continuation-in-part of U.S. patent application Ser. No. 08/511,917 now U.S. Pat. No. 5,622,287 filed on Aug. 7, 1995 by the same inventor herein, and entitled "Double Action Liquid Dispenser".

BACKGROUND OF THE INVENTION

1. Field of the Invention

The present invention involves trigger sprayers which rely upon trigger action by a user for spraying liquids such as varnished lacquers and similar fast-drying materials, as well as, more slowly drying materials. More particularly, the present invention relates to a double action trigger sprayer, i.e., one which sprays liquid both when the trigger moves forward and when the trigger moves in reverse. The present invention trigger sprayers eliminate a number of parts and significantly reduce valve friction and wearing of components compared to the Prior Art devices.

2. Information Disclosure Statement

Various double action sprayers have been developed over the years and the Academy of Sciences of Czechoslovakia developed a double action liquid atomizer and a double action trigger sprayer liquid atomizer. In addition, the same inventor herein has a patented double action spray dispenser with a continuous spray action. These are described in the patent literature as follows:

U.S. Pat. No. 4,503,996 issued to Miloslav Sorm et al. describes a liquid atomizer having a reciprocable pump. The atomizer provides a reliable sealing of the piston rod of the pump with lowered requirements as to the manufacturing tolerances of parts, a simplified manner of venting, and the sealing of the atomizer against leakage when the atomizer is placed in any arbitrary rest position. A sleeve having a smaller inner diameter than the cylinder is mounted on the upper part of the cylinder of the pump and its upper part is in contact with the inner part of a neck of a housing for the atomizer. A free space between the inner wall of the housing and the outer wall of the cylinder of the pump is connected below with the interior of the bottle on which the atomizer is mounted, and the upper part of the free space communicates with the surface of a tube by radial channels passing through the sleeve of the cylinder. The tube slidingly passes through the neck of the housing, is connected on the top with an operating button, and ends below with a sealing cuff piston which covers, when in its upper position, the radial channels and, at the same time, bears by its upper part on the neck of the housing. The tube forms a part of a narrow upper part of a piston rod which reciprocates through the sleeve, whereas the lower broadened part of the piston rod bears the piston of the pump and a one-way valve.

U.S. Pat. No. 4,646,969 issued to Miloslav Sorm et al. describes a double-acting mechanical liquid spraying device having a housing which is adapted to be mounted upon and sealed to the neck of a liquid container, and which has a liquid-containing compartment therein. In the housing, aligned with the liquid-containing compartment, there is an operation cylinder which has an annular valve seat disposed transversely to an intermediate the length of such cylinder. Disposed within the liquid-containing compartment is a liquid pumping plunger of the cuff type which cooperates with the valve seat to close the opening through such seat when the plunger is in its forward terminal position, and which is driven to reciprocate within the liquid-containing compartment in forward and reverse liquid dispensing strokes. In each of such strokes the plunger forwards liquid from the liquid-containing compartment to a spray nozzle through a liquid-conducting passage. Interposed in the liquid-conducting passage between the plunger and the spray nozzle are a relief valve and a relief passage which bleed liquid back to the liquid container and allow atmospheric air to be drawn in through the spray nozzle at the end of the reverse stroke of the plunger, thereby to clear the spray nozzle of liquid at the end of each pumping cycle consisting of a forward and a reverse stroke. As a consequence, fast-drying liquids can be sprayed with the device of the invention.

The commercial embodiments of the vertical reciprocal sprayer of U.S. Pat. No. 4,503,996, included visions in which the spray nozzles were replaced with tube nozzles for liquid dispensing without spraying, e.g. for creams and lotions.

U.S. Pat. No. 5,465,880 to Glynn pertains to a continuous action spray dispenser for spraying liquid material therefrom. It includes a main housing with a housing outlet and a housing inlet, adapted to receive a pumping rod and having a connecting mechansim for connection to a container. It also includes a pumping rod having a predetermined shape, volume and displacement with a first, upward position and a second downward position and includes a valve seat and one-way valve which permits liquid material to pass therethrough in a relative direction toward the outlet, but not toward the inlet. There is a top housing connected to the upper end of the main housing adapted for reciprocal movement with an activator. This is prior art by the same inventor herein which has issued less than one year before the filing date of the invention herein.

Notwithstanding the above prior art, there are no teachings or suggestions that would render the present invention anticipated or obvious. In fact, the Czech double action sprays and liquid dispensers rely upon a cuff type piston and valve and this cuff acts as a valve by being spread open on the forward stroke so as to prevent passage of liquid past it and squeezed closed on the reverse stroke so as to permit liquid to pass by it. However, this cuff acts as a valve with its seat being essentially the side walls of the chamber. In other words, the cuff and chamber walls move relative to one another and this abrasion causes leakage, unusual wear and sometimes volume problems. Thus, the present invention is directed to overcoming these shortcomings of the aforesaid prior art.

SUMMARY OF THE INVENTION

The present invention is a continuous action trigger sprayer for spraying liquid material, such as varnished lacquers and similar fast drying materials, as well as, more slowly drying materials. It includes a main housing having means for connecting to a container and having an operation cylinder and a liquid chamber. It also includes a pumping element which is located within the operation cylinder so as to be horizontally reciprocally movable therein. The pumping element has a predetermined shape, volume and displacement with a first, forward position and a second, rearward position and includes a valve seat, a one-way valve and a pumping rod located on a forward position of the pumping element which permits liquid material to pass therethrough in a relative direction toward a spray nozzle, but not toward the liquid chamber. There is also a relief valve having a seat with an opening therethrough and a relief passage to bleed liquid back to the container and to allow atmospheric air to be drawn in through the spray nozzle at the end of the reverse movement of the pumping element causing the spray nozzle to be cleared of liquid. There is a trigger located on an upper surface of the body, which drives the pumping element and has a first position and a second position corresponding to the pumping element first position and second position.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
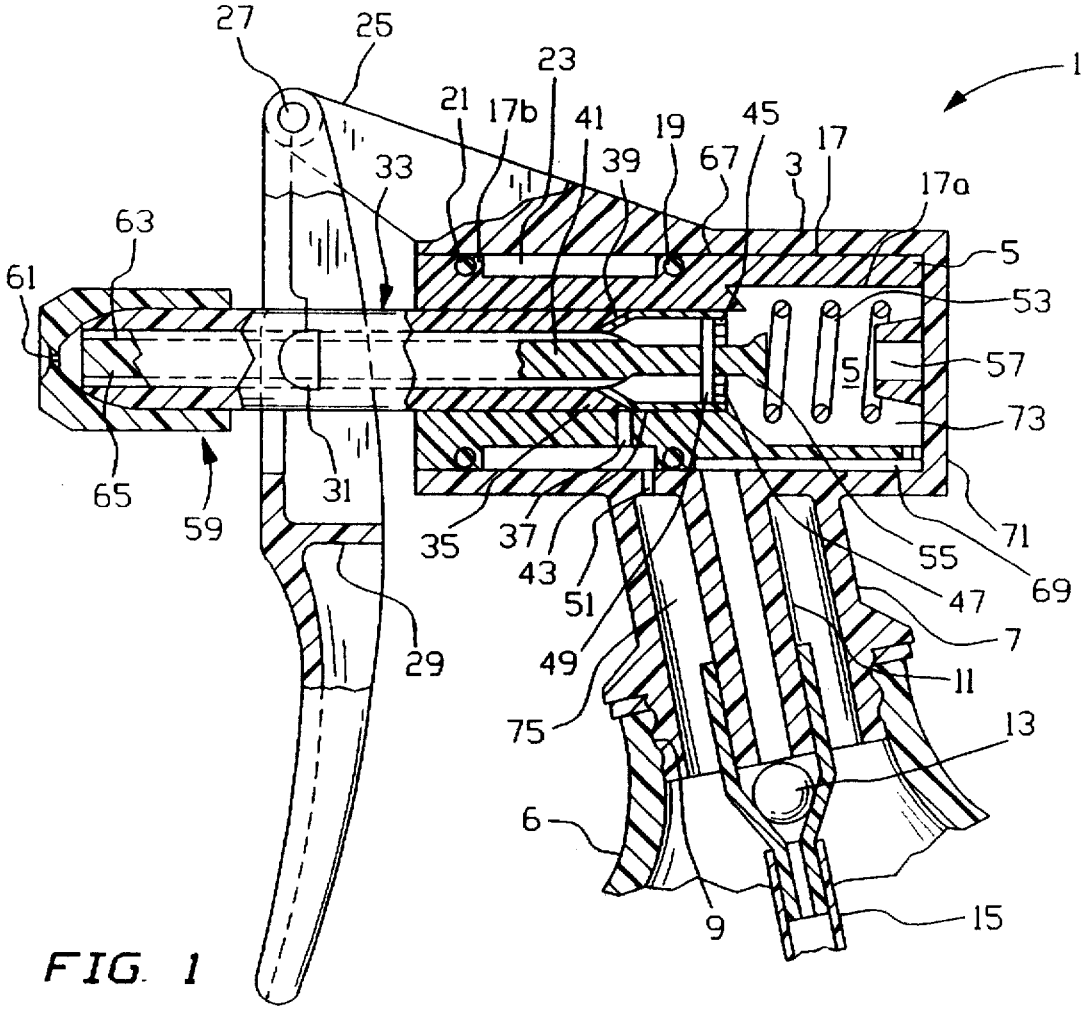
FIG. 1 shows a fragmentary view partially in side elevation and partially in vertical axial section of a preferred embodiment of a continuous acting trigger sprayer in accordance with the invention, the trigger sprayer being shown mounted upon the neck of a fragmentally illustrated liquid container and having a pumping element with a one way washer-type valve.

The present invention is a continuous action trigger sprayer which is used for spraying liquid material, especially varnished lacquers and similar fast drying materials. It can also be used for more slowly drying materials. The trigger sprayer is comprised of the following components:

(a) A main housing, which has an operation cylinder aligned with a liquid chamber. The main housing is adapted to receive a pumping element therein and has means for connection to a container.

(b) A pumping element, which is at least partially located within the operation cylinder so as to be horizontally reciprocally movable therein. The pumping element has a predetermined shape, volume and displacement and has a first position and a second position within the liquid chamber. The first position results from forward movement and establishes a minimum portion of volume of said pumping element within said liquid chamber, and permits a predetermined maximum available volume for liquid material within the liquid chamber. The second position results from rearward movement and establishes a maximum portion of volume of said pumping element within said liquid chamber, and permits a predetermined minimum available volume within the liquid chamber for liquid material due to volume displacement by the pumping element.

The pumping element includes thereon a valve seat, one way valve and pumping rod. The one way valve may be a flap valve, a spider valve or a ball valve. The valve seat and one way valve both move together with the pumping element when the pumping element is moved. The one way valve, which is located on a rearward portion of the pumping element, permits liquid material to pass therethrough in a relative direction toward a spray nozzle, but not toward the liquid chamber and does not contact the wall of the operation chamber. The pumping rod is located on a forward portion of the pumping element opposite the location of the seat and one way valve.

(c) A relief valve which has a seat with an opening therethrough and a relief passage. The relief passage bleeds liquid back to the container and allows atmospheric air to be drawn in through the spray nozzle at the end of the reverse movement of the pumping element causing the spray nozzle to be cleared of liquid. The relief valve seat cooperates with the pumping element to close the opening through the seat when the pumping element is in its forward position.

(d) A trigger, which is located on an upper surface of the body and drives the pumping element for reciprocal movement. The trigger has a first position and a second position corresponding to the pumping element's first position and second position.

(e) A spring mechanism, which is cooperatively located between the pumping element and the rear of the main housing and biasing the trigger and pumping element to their first position.

When the main housing is connected to a container having liquid therein and the trigger is reciprocated to prime, the trigger and therefore the pumping element is then moved from the first position to the second position. The liquid material in the liquid chamber from a preceding cycle then passes through the pumping element one way valve and seat and at least a portion thereof exits through a liquid conduction means and the spray nozzle.

When the trigger and therefore the pumping element is then returned from the second position to the first position via return of said spring mechanism, the liquid material in the container is sucked upwardly into the liquid chamber and liquid material in the area forward the closed valve exits through the liquid conduction means and the spray nozzle. By repeated forward and reverse strokes of the trigger, a continuous action spray is created.

Referring now to FIG. 1, a continuous action trigger sprayer 1 has a main body 3 having an axially extending circular cylindrical bore 5 therewithin. Means is provided to mount the spraying system 1 upon the neck 6 of a liquid container, such means being in the form of a tube 7 formed integrally with the main body 3 and extending rearwardly (to the right) at a slight angle beyond the perpendicular with respect to the axis of the main body 3.

Alternatively, the means could also attach the trigger sprayer 1 to a rim of a container. Such means would be in the form of a snap on attachment mechanism or a crimp seal. The means can also be in the form of a threaded attachment mechanism as part of the main housing and a separate attachment component adapted for non-threaded attachment to a container and having threads for cooperation with the threaded attachment mechanism.

In the embodiment shown, the tube 7 is provided with an external annular flange which engages an annular sealing washer interposed between the bottom surface of the flange and the upper surface of the neck 6 of the container. The tube 7 is held upon the container by a threaded connection 9, such connection being formed by external threads on the tube 7 below the flange thereon, such external threads mating with internal threads on the upper end of the neck 6 of the container.

Another tube 11 disposed within and coaxial of the tube 7 and formed integrally therewith and with the main body 3, has a check valve 13 mounted on the lower end thereof, the lower end of the tubular outer member of the check valve 13 being connected to the upper end of a dip tube 15 which leads downwardly within the interior of the fragmentarily shown liquid container. The check valve 13 permits the passage of liquid from the container upwardly within the tube 11, but prevents the return of such liquid downwardly into the container.

An operation cylinder 17 is mounted within the bore of the main body 3 coaxially thereof and is sealed thereto by a rear O-ring 19 and a forward O-ring 21. After assembly of such parts, the operation cylinder 17 has a first, rear, circular cylindrical bore 17*a* therewithin, and a second, front, smaller diametered bore 17*b* therein, such bores being coaxial. The junction between the bores 17*a* and 17*b* is in the form of a rearwardly converging frusto-conical or annular wedged-shaped surface. Between the forward O-ring 21 and the rearward O-ring 19, the forward portion of the operation cylinder is provided with an elongated annular recess, such recess forming an annular cavity 23 with the confronting portion of the wall of the bore 5 in the main body 3.

The body 3 is provided with a forwardly and angularly upwardly directed projection 25 on its upper surface, such projection 25 serving as a support for a pivot pin 27 to which the upper end of a control trigger or handle 29 is pivotally connected. An intermediate portion of the trigger 29 is pivotally connected by oppositely directed pivot means, one of which is shown at 31, to a piston 33 in the form of an elongated sleeve.

The piston 33 has the rear end thereof slidably mounted within the bore 17*b* of the operation cylinder 17. The piston 33 has a diameter of from approximately 0.05 to 0.20 mm less that the diameter of the bore 17*b*. The inner or rear end of the piston 33 is made in the form of a cuff piston 35 opening to the rear which sealingly cooperates with the bore 17*b* and which functions as the movable element of a valve which selectively opens and closes a liquid bleeding hole or opening 37 in the forward portion of the operation cylinder 17.

Within the tubular piston 33, there is mounted a pumping element 39 which includes a rod 41, a valve support 43 having a plurality of inlets such as 45 and 47, and a washer-type valve 49 and is attached to a narrower or constricted portion of the pumping element 39. The pumping element 39 and consequently the washer-type valve 49 are constantly urged forwardly, that is to the left, by a coil compression spring 53 which acts between a spring seat 55 on the rear of the pumping element 39 and a spring seat 57 on the rear of the main body 3 of the double action trigger sprayer 1.

Although this embodiment shows a washer type valve, alternatively, a one-way flap valve, a spider valve or a ball valve could also be employed.

As can be seen, the pumping element 39 has a predetermined shape, volume and displacement. When the pumping element 39 is urged to its forward position, the pumping element 39 is in its first position. By pushing the trigger 29, the pumping element 39 is moved to it rearward position and pumping element 39 is in its second position.

A spraying nozzle 59 is provided on the outer left-hand end of the pumping element 39 and the outer, left-hand end of the piston 33. With the parts in the positions thereof shown in FIG. 1, the left-hand end surfaces of the pumping element 39 and the tubular piston 33 lie in a common transverse plane. The spraying nozzle 59 includes an annular member having a circular cylindrical tubular portion telescoped over the outer end of the tubular piston 33 and a frusto-conical portion converging to the left, as shown. A central axially directed spray aperture 61 is formed in the end portion of the spraying nozzle 59.

Liquid under pressure is fed to the interior of the nozzle 59 and thus outwardly through the spray aperture 61 by means of at least one axially extending groove 63, 65 in the outer surface of the pumping element 39. Such liquid under pressure is supplied to the grooves 63, 65 and thus to the spray nozzle 59 by the action of the pumping element 39 when the pumping element 39 moves to its forward position under the thrust exerted upon it by the coil compression spring 53 and by the cuff 35 of the piston 33 when the piston 33 is thrust to the rear by the counter-clockwise swinging of the trigger 29 acting through the pivot means 31.

Upon the forward stroke of the pumping element 39, liquid is sucked upwardly from the container through the dip tube 15 to the check valve 13, upwardly through a transverse annular passage 67 into the tube 11 through a passage 69 formed as a groove in the portion 17*a* of the cylinder 17 and thus radially inwardly through a passage 71. Liquid thus fills the liquid chamber 73, which is the area surrounding the spring 53. It is this body of liquid which is dispensed in both the oppositely directed strokes of the trigger sprayer 1 as the trigger 29 is oscillated.

The pumping element 39 and the piston 33 move together as a unit with a small endwise play between them to the rear when the trigger 29 is oscillated counterclockwise, since the left hand end of the pumping element 39 is engaged by the inner surface of the spray nozzle 59, whereby in the initial part of such rearward stroke, the cuff piston 35 soon travels to and seals the radial opening 37 in the wall of portion 17*b* of operation cylinder 17, thus permitting the liquid to be transmitted through the grooves 63, 65 to the spraying nozzle 39 under pressure.

When the trigger 29 is released and the coil spring 53 thrusts the pumping element 39 to the left, the pumping element 39 thrusts the liquid in the area forward the closed valve 49 to the left under pressure through the grooves 63, 65 to the spray nozzle 39. Such discharge under pressure continues until the tubular piston 33 moves to the left sufficiently for the sealing cuff 35 thereon to uncover the radial opening 37 so that the remainder of the liquid, which would otherwise be forwarded to the spray nozzle 39, is now bled through the radial opening 37 in the main body 3 which drains the liquid in space 23 downwardly into a radial hole 51 in the housing 3 and into a passage 75 which leads the liquid back into the container.

In operation, the spring 53 presses the pumping element 39 to the left into the rest position thereof shown in FIG. 1. The pumping element 39 and thus also the longitudinal grooves 63, 65 and the spray nozzle 59 are connected with the liquid container through the transverse channels 37, 23., 51 and 75. Assuming that the liquid chamber 73 and all space extending therefrom to the check valve 13 are filled with liquid from a preceding operation, the liquid starts to flow by pushing the trigger 29 in a counterclockwise direction, that is to the right, to thrust the pumping element 39 into the space located where the spring is in a depressed position. The one way valve 49 moves forward and the liquid is able to pass through the inlets 45, 47. For a first short moment, the liquid then flows through the longitudinal channels 63, 65, the opening 37 and the transverse channels 23, 51, 75 back into the liquid container.

After the valve made of the cuff 35 on the piston 33 and the opening 37 closes, that is after the cuff 35 covers the passage 37, all of the liquid now flows to the left through the longitudinal grooves 63, 65 toward the spray nozzle 59. Air is sucked into the container through the clearance between the piston 33 and the bore 17*b* and entrains a contingent leaking liquid through the opening 37 and the transverse channels 23, 51, 75 back into the container.

If the control trigger is then released, the spring 53 pushes the pumping element 39 forward, that is to the left, and the one way valve 49 is forced down and seals off the inlets 45, 47 and no liquid is allowed to pass therethrough. However, the liquid is forced out from the portion of the pumping element forward the closed one way valve, that is the portion to the left. The liquid passes through the longitudinal channels 63, 65 into the spraying nozzle 59. By the repeated pushing and releasing of the trigger 29, a virtually continuous cloud of sprayed liquid is formed.

During the operation of the trigger sprayer 1, there is a liquid seal between the piston 33 and the pumping element 39 which lets enough air into the trigger sprayer i for a reliable operation thereof, but does not allow a fast and complete equalizing of the inner and outer air pressure. After the spray operation has been completed, the control trigger 29 is completely released and a residual under pressure in the container is equalized with the atmospheric pressure through the spraying nozzle 29, whereby the liquid form the spraying nozzle 29 is sucked through the longitudinal grooves 63, 65, the opening 37 and the transverse channels 23, 51, 75 back into the container.

Figure 2:
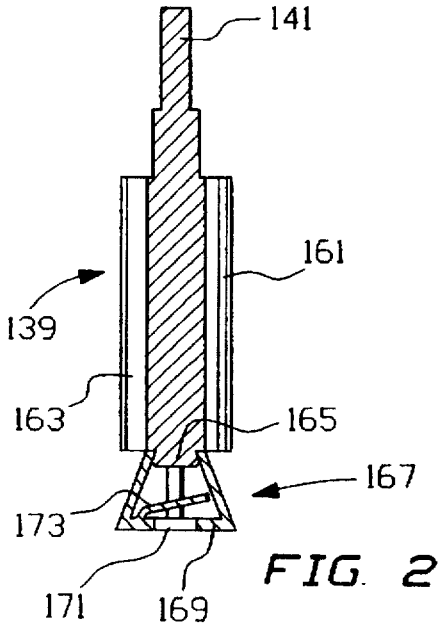
FIG. 2 shows an alternate embodimentent of a crosssection of a pumping element with a one way spider valve.

FIG. 2 shows an alternate embodiment of a pumping element 139. The pumping element 139 has a pumping rod 141 and arcuate cut outs 161 and 163 to allow liquid to pass by it. At the bottom of the pumping element 139 is a snap bead knuckle 165 adapted to receive a one way spider valve 167. The one way spider valve 167 includes four uprights biased inwardly to attach to the knuckle 165, an opening 171, a base 169 which acts as a seat and a flap valve 173. The flap valve 173 functions generally in the same manner as the washer type valve and is closed when the pumping element 139 moves forward and is open when it moves rearward.

Figure 3:
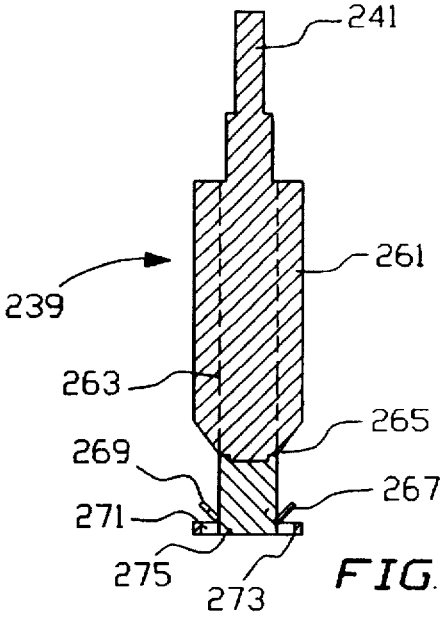
FIG. 3 shows yet another alternate embodimentent of a crosssection of a pumping element with a one way flap valve.

FIG. 3 shows yet another alternate embodiment of a pumping element 239. The pumping element 239 includes a pumping rod 241 and semicircular cutouts 261 and 263. At the bottom of the pumping element 239 is an attachment knuckle 265 adapted to receive valve and valve seat shown generally as valve mechanism 275. There is a plurality of flap valves such as valves 267 and 269 connected to openings 273 and 271, respectively. There could be two, three or four such valves and these operate similarly to the valve discussed with respect to FIG. 1. In other words, they open when the pumping element 239 is moved rearward and are forced closed when the pumping element 239 moves forward.

It should now be seen that the present invention double action trigger sprayer has an enhanced arrangement, whereby the valve which moves with the pumping element does not frictionally drag against its seat nor does it move in such a way that it could wear out or fail along side walls as the valve seat moves with the valve and the pumping element in the present invention device.

Obviously, numerous modifications and variations of the present invention are possible in light of the above teachings. For example, many different types of valves may be used. It is therefore understood that within the scope of the appended claims, the invention may be practiced otherwise than as specifically described herein.

What is claimed is:

1. A continuous action trigger sprayer for spraying liquid material therefrom, which comprises:

a) a housing having means for connection to a container and having a liquid chamber aligned with an operation cylinder;

b) a pumping element located in said operation cylinder and being driven to reciprocate in horizontal forward and rearward strokes to dispense liquid from said liquid chamber, said pumping element having a predetermined shape, volume and displacement and having a first position and a second position within said operation cylinder, said first position resulting from forward movement and establishing a minimum portion of volume of said pumping element within said liquid chamber and permitting a predetermined maximum available volume within said liquid chamber for liquid material, said second position resulting from rearward movement and establishing a maximum portion of volume of said pumping element within said liquid chamber and permitting a predetermined minimum available volume within said liquid chamber for liquid material due to volume displacement by said pumping element, and said pumping element including thereon a valve seat, a one way valve and a pumping rod such that said valve seat, said one way valve and said pumping rod move together with said pumping element when said pumping element is moved, said one way valve permitting liquid material to pass therethrough in a relative direction toward a spray nozzle, but not toward said liquid chamber, both said valve seat and said one way valve being located on a rearward portion of said pumping element such that said one way valve does not contact the wall of said operation cylinder, said spray nozzle being located on said housing and being connected to a liquid conducting means which allows liquid to flow from said pumping element to said spray nozzle, said pumping rod being located on a forward portion of said pumping element; and c) a relief valve connected to a trigger and having a seat with an opening therethrough and a relief passage to bleed liquid back to the container and to allow atmospheric air to be drawn in through said spray nozzle at the end of the rearward movement of said pumping element whereby said spray nozzle is cleared of liquid, said relief valve seat cooperating with said pumping element to close said opening through said seat when said pumping element is in its forward position, said trigger being located on an upper surface of said body and having a first position and a second position corresponding to said pumping element first position and second position;

such that when said trigger is reciprocated to prime and when said trigger and therefore said pumping element is moved from said first position to said second position, liquid material passes through said one way valve and seat and at least a portion thereof passes successively through said liquid conducting means and said spray nozzle, and when said trigger and therefore said pumping element is then returned to said first position, liquid material is sucked upwardly from said container and liquid material in the area forward the closed valve exits through said liquid conduction means and said spray nozzle, thereby creating a continuous action spray on forward and rearward strokes of said trigger.

2. The continuous action trigger sprayer of claim 1 further including a spring mechanism biasing said trigger and said pumping element to their first position.

3. The continuous action trigger sprayer of claim 2 wherein said spring mechanism is a coil spring.

4. The continuous action trigger sprayer of claim 3 wherein said one way valve and seat is a one way flap valve and seat.

5. The continuous action trigger sprayer of claim 3 wherein said one way valve and seat is a spider valve and seat.

6. The continuous action trigger sprayer of claim 3 wherein said one way valve and seat is a ball valve and seat.

7. The continuous action trigger sprayer of claim 4 wherein said main housing has a threaded attachment mechanism for attachment of said trigger sprayer to threading on a threaded neck of a container.

8. The continuous action trigger sprayer of claim 4 wherein said main housing has a snap on attachment mechanism for attachment of said trigger sprayer to a rim of a container.

9. The continuous action trigger sprayer of claim 4 wherein said main housing has a crimp seal attachment mechanism for attachment of said trigger sprayer to a rim of a container.

10. The continuous action trigger sprayer of claim 7 wherein said relief valve includes a cuff piston on the rear end of a piston.

11. The continuous action trigger sprayer of claim 10 wherein said pumping element is mounted within said piston.

12. The continuous action trigger sprayer of claim 11 wherein the forward surface of said pumping element and said piston lie in a common transverse plane.

13. The continuous action trigger sprayer of claim 12 further including a dip tube attached thereto.

14. The continuous action trigger sprayer of claim 13 wherein said trigger is attached to a forwardly and angularly upwardly directed projection on an upper surface of said body.

15. The continuous action trigger sprayer of claim 14 wherein said pumping element further includes a valve support attached to a narrower portion of said pumping element.

16. The continuous action trigger sprayer of claim 15 wherein said valve support has a plurality of inlets.

17. The continuous action trigger sprayer of claim 16 wherein said relief valve is interposed between said pumping element and said spray nozzle.

18. The continuous action trigger sprayer of claim 17 wherein said pumping element has a cross section smaller than the cross section of said operation cylinder.

19. The continuous action trigger sprayer of claim 4 wherein said means for attachment to a container includes a threaded attachment mechanism as part of said main housing, and a separate attachment component adapted for non-threaded attachment to a container and having threads for cooperation with said threaded attachment mechanism.

* * * * *